US008964996B2

(12) United States Patent
Klippel et al.

(10) Patent No.: US 8,964,996 B2
(45) Date of Patent: Feb. 24, 2015

(54) METHOD AND ARRANGEMENT FOR AURALIZING AND ASSESSING SIGNAL DISTORTION

(71) Applicants: Wolfgang Klippel, Dresden (DE); Marian Liebig, Dresden (DE)

(72) Inventors: Wolfgang Klippel, Dresden (DE); Marian Liebig, Dresden (DE)

(73) Assignee: Klippel GmbH, Dresden (DE)

( * ) Notice: Subject to any disclaimer, the term of this patent is extended or adjusted under 35 U.S.C. 154(b) by 248 days.

(21) Appl. No.: 13/766,572

(22) Filed: Feb. 13, 2013

(65) Prior Publication Data

US 2014/0226828 A1 Aug. 14, 2014

(51) Int. Cl.
*H04R 29/00* (2006.01)

(52) U.S. Cl.
USPC ..... 381/56; 381/58

(58) Field of Classification Search
None
See application file for complete search history.

(56) References Cited

U.S. PATENT DOCUMENTS

2003/0187636 A1* 10/2003 Klippel et al. ..... 704/220
2011/0015898 A1* 1/2011 Klippel ..... 702/185

OTHER PUBLICATIONS

Farina et al., "Real-Time Auralization Employing a Not Non-Linear, Not Time-Invariant Convolver", 123rd Convention of the Audio 2007, Oct. 5-8, NY, 37 pgs.
Feiten B., "Measuring the Coding Margin of Perceptual Codecs With the Difference Signal", 102nd Convention of the Audio Eng. Soc., 1997, Munich, #4417, pp. 1-16.
Klippel, Wolfgang, "Speaker Auralization—Subjective Evaluation of Nonlinear Distortion", 110th Convention of AES, May 12-15, 2001, Amsterdam, pp. 1-8.
Thiede, et. al., "PEAQ—The ITU Standard for Objective Measurement of Perceived Audio Quality," J. Audio Eng. Soc., vol. 48, No. 1/2 , Jan./Feb. 2000, p. 2-29.
Rodriguez, M.S., "Modeling and Real-Time Auralization of Electrodynamic Loudspeaker Non-Linearities", ICASSP 2004 of the IEEE,pp. IV-81-IV-84.

* cited by examiner

*Primary Examiner* — Paul Huber
(74) *Attorney, Agent, or Firm* — Koppel, Patrick, Heybl & Philpott

(57) ABSTRACT

An arrangement and method for assessing the audibility and annoyance of at least one distortion component $d_n(t)$ with n=1, . . . , N in the output signal p(t) of a device under test, by generating a virtual auralization output signal $p_A(t)$ at the output of an auralization system. The output signal $p_A(t)$ contains the distortion component $d_n(t)$ at an adjustable magnitude according to a scaling factor $S_n$ provided from a control input, and is supplied to a perceptive model and to a reproduction system used by a listener. The auralization system receives the distortion component $d_n(t)$ from a separator which receives a test signal $x_T(t)$ from the output of a microphone and a reference signal $x_R(t)$ from a reference system.

46 Claims, 5 Drawing Sheets

METHOD AND ARRANGEMENT FOR AURALIZING AND ASSESSING SIGNAL DISTORTION

FIELD OF THE INVENTION

The invention generally relates to an arrangement and a method for assessing the audibility and annoyance of signal distortion generated in the output of an audio device (such as loudspeakers) or any other transfer system by combining perceptive evaluation and physical measurements.

DESCRIPTION OF THE RELATED ART

An audio system (e.g., a loudspeaker) excited by a stimulus u(t) such as a test signal or music generates an output signal (e.g., the sound pressure) p(t) given by:

$$p(t)=\alpha u(t-\tau_0)+d_{lin}(t)+d_{nlin}(t)+d_{irr}(t)+n(t) \quad (1)$$

comprising the undistorted input u(t), linear distortions $d_{lin}(t)$, regular nonlinear distortions $d_{nlin}(t)$, irregular nonlinear distortions $d_{irr}(t)$ and noise n(t). A frequency independent gain factor $\alpha$ and a constant time delay $\tau_0$ generated by the audio system or by the sound propagation between source and listening point are not considered as signal distortion.

The linear distortion component $d_{lin}(t)$ is generated by electro-acoustical transduction and the sound propagation in the acoustical environment (e.g. room).

At higher amplitudes the nonlinearities in the transducer generate the nonlinear distortion $d_{nlin}(t)$, which appear as new spectral components in the output signal. However the nonlinearities in the motor and mechanical suspension are considered as regular because they are predictable and directly related to the design of the transducer. Usually a compromise between cost, weight, size and sound quality is required to create a product which satisfies the needs of the user.

The irregular distortions $d_{irr}(t)$ do not arise from loudspeaker design, but are generated by defects caused by the manufacturing process, ageing and other external impacts (overload, climate) during the later life cycle of the product. For example, loose particles, a rubbing coil and turbulent air flow generated by enclosure leaks generate distortions $d_{irr}(t)$ which are not predictable and have a stochastic nature.

The noise component n(t) may be generated by the sensor used to acquire the output signal p(t) or by an external noise source in the acoustical environment.

For an objective assessment of the distortion, a variety of physical measurement techniques have been developed which exploit particular properties of each component. The linear distortion $d_{lin}(t)$ is evaluated by using the impulse response or a complex transfer function measured in the small signal domain where the other distortions $d_{nlin}(t)$ and $d_{irr}(t)$ are negligible. The regular nonlinear distortions $d_{nlin}(t)$ are usually assessed by using a special test signal with a sparse spectrum (e.g. a single tone) to distinguish the harmonics and intermodulations from the fundamental components. Special measurement techniques have been developed to consider the random and transient properties of the irregular distortion $d_{irr}(t)$.

The results of the distortion measurements highly depend on the properties of the stimulus u(t) exciting the audio system under test. Although some measurement techniques (e.g. incoherence) are capable of assessing regular nonlinear distortion while reproducing music or speech, most techniques use a special test signal (e.g. sinusoidal chirp) to measure nonlinear symptoms at the highest sensitivity and speed.

Furthermore, the metric of the characteristics derived from physical data does not correspond with the results of perceptive evaluation of the audio system. The psycho-acoustical processing of the signal in the ear and in the upper cognitive layers of the brain determine the audibility of the distortions, their annoyance and the final impact on the perceived sound quality of the audio reproduction.

To overcome the limits of conventional instruments based on physical measurements, new kinds of objective evaluation techniques have been developed which consider the transmission of the signal in the peripheral ear, time-frequency decomposition, generation of an excitation pattern and the extraction of features (MOVs) describing loudness, sharpness and other basic perceptive attributes. For the evaluation of the perceptual coding of audio signals, an ITU standard has been developed (Thiede, et. al., "PEAQ—The ITU Standard for Objective Measurement of Perceived Audio Quality," J. Audio Eng. Soc. Vol. 48, No 1/2, January/February, 2000, p. 2-29). B. Feiten suggested in his preprint "Measuring the coding margin of perceptual codecs with the difference signal," presented at the 102$^{nd}$ convention of the Audio Eng. Soc., 1997, Munich, #4417, a technique for assessing CODECs by comparing the input signal x(n) with the output signal y(n).

Existing perceptive evaluation systems developed for CODECs and other applications are not directly applicable to loudspeakers and complete audio systems. Although the basic psycho-acoustical mechanisms are identical, the prediction of the perceived overall sound quality grading cannot replace listening by the human ear. There is further research required to assess adequately the impact of roughness and fluctuations of higher frequency bands caused by intermodulations with a low frequency bass signal due to the nonlinearities of a moving coil transducer. Furthermore, an overall rating such as preference or annoyance is the result of higher cognitive processing of the basic perceptional features in a multi-dimensional space using ideal points influenced by experience, training and cultural background of the listener.

Therefore, a trained human ear is required to evaluate the performance of an audio device during product development. Systematic listening tests are time consuming and expensive. Some perceptional features (e.g. loudness) are dominant and may mask other features (e.g. spectral colorations) in overall grading. It is known that the perception is a adaptive learning process and some properties (e.g. room influence) which are constant during the test become less important over time. Thus, listening tests reveal the perception of the dominant distortion but cannot describe the degree to which other distortions are imperceptible. However, this information is required to optimize the performance/cost ratio and to adjust the product to the final target application. For example, a more linear motor topology in moving-coil loudspeakers reduces regular nonlinear distortion at the expense of reduced efficiency or an increase of material resources.

Auralization techniques have been developed for the evaluation of nonlinear distortion by combining measurement and modeling. In the prior art there two basic approaches for generating a virtual acoustical output:

Farina, et. al. suggested a "Real-time Auralization Employing a Not Non-Linear, Not Time-Invariant Convolver" in his paper presented at 123$^{rd}$ Convention of the Audio 2007, Oct. 5-8, NY. It is also possible to model the device under test with a Volterra-series, neural network or other nonlinear systems having a generic structure. M. S. Rodríguez suggested in a paper "Modeling And Real-Time Auralization of Electrodynamic Loudspeaker Non-Linearities," presented at the ICASSP 2004 of the IEEE, to use available information from the physics of the transducer. Both auralization techniques have in common that the fraction of the distortion in the virtual auralization output is varied by changing the free parameters of the model. However, parameter verification of the model also affects internal state variables such as displacement, voice coil temperature and the sound pressure output.

Therefore, Klippel suggested in "Speaker Auralization—Subjective Evaluation of Nonlinear Distortion" presented at the 110th Convention of AES, 2001 May 12-15 Amsterdam, a technique which uses a model of the moving coil loudspeaker combined with a synthesis of a virtual output. The effects of the nonlinear stiffness $K_{ms}(x)$, force factor Bl(x) and inductance L(x) are represented by nonlinear subsystems generating nonlinear distortion $p_k(t)$, $p_b(t)$ and $p_t(t)$ added to the linear input $p_{lin}(t)$ to generate the total sound pressure output p(t). This model also feeds sound pressure output p(t) to the input of the nonlinear subsystems, generating a feedback loop. This model structure is a useful approximation of the dominant nonlinearities $K_{ms}(x)$, Bl(x) and L(x), but cannot be applied to acoustical nonlinearities in vented-port systems generating internal nonlinear dynamics. The linear and nonlinear signals are individually scaled and mixed to an auralization output $p_A(t)$. The scaling of the signal component affects the distortion ratio in the auralization output, but has no effect on the internal states of the loudspeaker model.

All of the known auralization techniques fail for assessing the irregular distortion $d_{irr}(t)$ separately. A detailed physical model of the distortion generation is usually not available, due to the complexity and variety of physical causes of potential defects of the device under test. Irregular distortion $d_{irr}(t)$ comprise higher-order nonlinear distortion and cannot be modeled by a quadratic, cubic or other low-order homogenous subsystems as used in the Volterra and other generic models. The identification of a high number of free parameters in nth-order nonlinear systems with n>20 is not feasible by using available signal processing.

Objects of the Invention

Thus, there is a need for an auralization technique which can be applied to any kind of linear and nonlinear signal distortion found in audio devices or any other systems storing or transferring a signal. This auralization should be applicable for any input signal u(t) such as test signals, music or other audio signals. The auralization technique should exploit available information on the physics of the system under test to separate the distortion generated by each nonlinearity. The auralization should not be limited to distortion which is controllable and observable but should also include distortion generated by the internal nonlinear dynamics. An alternative auralization scheme is required to assess irregular nonlinear distortion where a detailed modeling of the physical generation process is not possible. A generic model which requires no physical information on the particular nonlinearity should comprise a low number of parameters which can be easily identified by available measurement techniques. The ratio of the distortion in the virtual auralization output should be adjustable and evaluated by a metric having a physical meaning. A further object is to use a minimum of hardware elements to keep the cost of the system low.

SUMMARY OF THE INVENTION

According to the present invention, the first auralization scheme exploits available information on physical modeling of the regular nonlinearities. Contrary to the prior art, the new auralization scheme is based on a state space model given by:

$$\dot{x}=A(x)x+B(x)u \tag{2}$$

with the state vector x and a nonlinear matrix A(x) and a nonlinear vector B(x) multiplied with the input signal u(t). The sound pressure or any other output signal of the audio system $$p=h(x) \tag{3}$$

is calculated from the state vector x by using a linear or nonlinear function h(x). The particular properties of the device under test are defined by the state variables in vector x and the linear and nonlinear parameters in A(x), B(x) and h(x).

It is a characteristic feature of the invention to separate the linear terms from the nonlinear terms on right hand-side of Eq. (2) giving $$\begin{aligned}\dot{x} &= A(0)x + B(0)u + (A(x) - A(0))x + (B(x) - B(0))u \\ &= \dot{z}_0 + \dot{z}_n\end{aligned} \tag{4}$$

using the null vector x=0 to assess the linear behavior of the transducer in the small signal domain. The linear signal components in the state vector $z_0$ complying with $$\dot{z}_0=A(0)z_0+B(0)u \tag{5}$$

and the nonlinear signal components in the state vector $z_n$ generated by $$\begin{aligned}\dot{z}_n &= A(0)z_n + (A(x) - A(0))x + (B(x) - B(0))u \\ &= A(0)z_n + A_n(x)x + B_n(x)u\end{aligned} \tag{6}$$

give the sound pressure output $$p_A(t)=G_A(h(z_0)+S_nh(z_n)). \tag{7}$$

It is a further feature of the invention that the exact auralization of the nonlinear distortion leads to a first feedback loop generating a multitude of state variables in the state vector x and a second feedback loop generating a multitude of state variables in the nonlinear state vector $z_n$. All nonlinear parameters in $A_n(x)$ and $B_n(x)$ depend on the state vector x.

The additional factor $S_n$ introduced in the equation above scales the nonlinear distortion components in the output signal $p_A(t)$. For $S_n=0$, the auralization output $p_A(t)$ corresponds with the linear approximation of the state space model valid in the small signal domain. Contrary to the auralization technique known in the prior art, the auralization output $p_A(t)$ for $S_n=1$ equals the sound pressure output p(t) of the exact model in Eqs. (2) and (3). The nonlinear distortion generated by all nonlinearities in the system can be enhanced in the auralization output $p_A(t)$ by using a scaling factor $S_n>1$ while the internal state variables in the state vector x are not affected.

The Total Distortion Ratio defined by $$TDR(t) = \frac{\underset{T}{\mathrm{Max}}|S_nh(z_n(t))|}{\underset{T}{\mathrm{Max}}|y_A(t))|}100\% \tag{8}$$

-continued $$= \frac{\underset{T}{\mathrm{Max}}|G_A S_n h(z_n(t))|}{\underset{T}{\mathrm{Max}}|p_A(t))|} 100\% \quad n = 1 \tag{9}$$

describes the ratio between the peak value of the total nonlinear distortion and the peak value of the total auralization output $p_A(t)$ within the time frame t and t+T.

The new approach can also be used to perform an auralization of the distortion components generated by the individual nonlinearities. Here the state vector x generated by $$\dot{x} = A(x)x + B(x)u \tag{10}$$

$$= \dot{z}_0 + \sum_{n=1}^{N} \dot{z}_n$$

comprises the linear state vector $z_0$ and a sum of nonlinear distortion vectors $z_n$ with n=1, . . . , N representing a multitude of N nonlinearities in the device under test.

Each distortion vector $z_n$ is described by $$\dot{z}_n = A(0)z_n + [A_n(x)x + B_n(x)u] \; n = 1, \ldots, N \tag{11}$$

using particular matrix $A_n(x)$ and $B_n(x)$ comprising selected nonlinear parameter variation (usually one parameter of particular interest) while all of the remaining parameter variations are set to zero. Contrary to the prior art suggested by Klippel, 2001, the matrix $A_n(x)$ and vector $B_n(x)$ depend on multiple state variables in the state vector x and not on a single scalar signal p(t).

The linear and nonlinear state vectors $z_0$ and $z_n$ allow the to calculatation of a virtual auralization output $$p_A = G_A\left(h(z_0) + \sum_{n=1}^{N} S_n h(z_n)\right) \tag{12}$$

by using an individual weight $S_n$ for each nonlinear distortion component.

The contribution of each nonlinearity to the total auralization output $p_A(t)$ can be described by the distortion ratio $$DR(t) = \frac{\underset{T}{\mathrm{Max}}|G_A S_n h(z_n(t))|}{\underset{T}{\mathrm{Max}}|p_A(t)|} 100\% \quad n = 1, \ldots, N \tag{13}$$

considering the peak values of the distortion component and total signal.

The present invention also discloses a second auralization technique which dispenses with detailed modeling and makes minimal assumptions on the distortion generation process. It requires a test signal $x_T(t)$ at the output of the device under test and a reference signal $x_R(t)$ generated by a reference system. The reference signal $x_R(t)$ contains stimulus u(t) without any distortion (e.g. music from a CD source) and any other signal distortion components in Eq. (1) which are accepted as desired or normal and which are not the subject of investigation. The reference signal $x_R(t)$ usually comprises less distortion than the test signal $x_T(t)$.

After applying signal processing to the test signal $x_T(t)$, and reference signal $x_R(t)$ a distortion component $d_n(t)$ is separated by a new differential decomposition exploiting the additive structure of the general signal model in Eq. (1). The distortions $d_n(t)$ found in test signal $x_T(t)$ are the basis for synthesizing an auralization output $p_a(t)$ with a user defined fraction of distortion.

The separated distortion component d(t) also depends on the properties of first and second transfer systems, $F_R$ and $F_T$, applied to the reference and test signal, $x_T(t)$ and $x_R(t)$, respectively. The outputs are transferred signals $x'_T(t)$ and $x'_R(t)$, which are usually more similar to each other than the inputs $x_T(t)$ and $x_R(t)$. The transfer systems $F_T$ and $F_R$ have different linear or nonlinear characteristics. The transfer characteristic may be fixed and adjusted by using external information or are determined automatically by a parameter estimation technique optimizing a cost function.

The following synthesis generates the difference signal $d_n(t)=x'_T(t)-x'_R(t)$, which comprises only distortion components which are the subject of the auralization. The difference signal d(t) is supplied to a linear system with the transfer function $H_D(s)$, which generates the scaled distortion component $d'_n(t)$ at the output. The transfer function $H_D(s)$ may be a constant scaling factor or a frequency dependent function, to weight particular spectral components in the distortion component $d_n(t)$. The transfer function may be modified externally by the user of the auralization.

A system $H_R$ generates from the transferred reference signal $x'_R(t)$ an auralization reference signal $y_R(t)$. The system $H_R$ may generate a noise signal n(t) added to transferred reference signal $x'_R(t)$ to simulate in the internal reference signal $y_R(t)$ ambient noise (e.g. wind noise) persistently affecting the auralization output.

The distortion component $d'_n(t)$ is added to the reference signal $y_R(t)$, giving the internal auralization signal $y_A(t)$. The ratio between the peak value of the distortion component $d'_n(t)$ and the peak value of the internal auralization signal $y_A(t)$ is a useful objective metric for assessing the fraction of the distortion within a certain time frame.

The auralization module may also comprise a scaling block where the sound pressure reference output $p_R(t)$ and the sound pressure auralization output $p_a(t)$ are generated from the corresponding internal signals $y_R(t)$ and $y_A(t)$, respectively. The auralization output signal $p_a(t)$ is evaluated by the human ear via a calibrated reproduction system (e.g. headphone). Systematic listening tests may be performed by asking test persons to compare auralization output $p_a(t)$ with reference output $p_R(t)$ while changing the amplitude of the distortion by controlling the transfer function $H_D(s)$.

Depending on the choice of test and reference signal and signal processing in the auralization technique, the fraction of any single distortion component or combination of those can be virtually changed in the auralization output. The most important configurations are:

I. Assessment of Total Distortion

In order to separate the sum of all distortion components $d_{lin}(t)$, $d_{nlin}(t)$ and $d_{irr}(t)$ in Eq. (1) from the delayed and scaled input signal $\alpha(u(t-\tau_0)$ in the test signal $x_T(t)=p(t)$, the stimulus u(t) is used as the reference signal $x_R(t)=u(t)$ at the input of the auralization system. The time delay $\tau_0$ and a gain factor $\alpha$ are estimated and used for aligning the two signals in the filters $F_T$ and $F_R$, which are in this case linear systems.

II. Assessement of Regular and Irregular Nonlinear Distortion

In order to keep the linear distortion component $d_{lin}(t)$ constant during the auralization procedure and to generate a virtual auralization output with variable content including both nonlinear distortion components distortion components $d_{nlin}(t)$ and $d_{irr}(t)$, the reference signal $x'_R(t)$ has to comprise the linear distortion component $d_{lin}(t)$ only. This signal can be generated by using the stimulus signal u(t) as the reference signal $x_R(t)$, and convoluting this signal with the scaled impulse response of the system under test in filter $F_R$. This impulse response should be measured at low amplitudes where the regular and irregular nonlinear distortions are negligible.

III. Assessment of Irregular Nonlinear Distortion

The auralization of the irregular nonlinear distortion $d_{irr}(t)$ requires that the linear and regular nonlinear distortions are captured in the transferred reference signal $x'_R(t)$. This can be accomplished by using a nonlinear system $F_R$ and the input signal u(t) as the reference signal $x_R(t)$ according to the state space model of the device under test such as presented in Eq. (2). The test signal $x_I(t)$ only contains irregular distortions generated by defects in the device under test.

Alternatively, a reference unit which has the desired properties as the device under test is used for generating a reference signal $x_R(t)$ comprising linear and regular nonlinear distortion only. The measurement of the reference unit, which is common practice in production testing for setting PASS/FAIL limits, dispenses with the generation of a nonlinear model $F_R$ of the device under test.

These and other features, aspects and advantages of the present invention will become better understood with reference to the following drawings, description and claims.

DETAILED DESCRIPTION OF THE INVENTION

Figure 1:
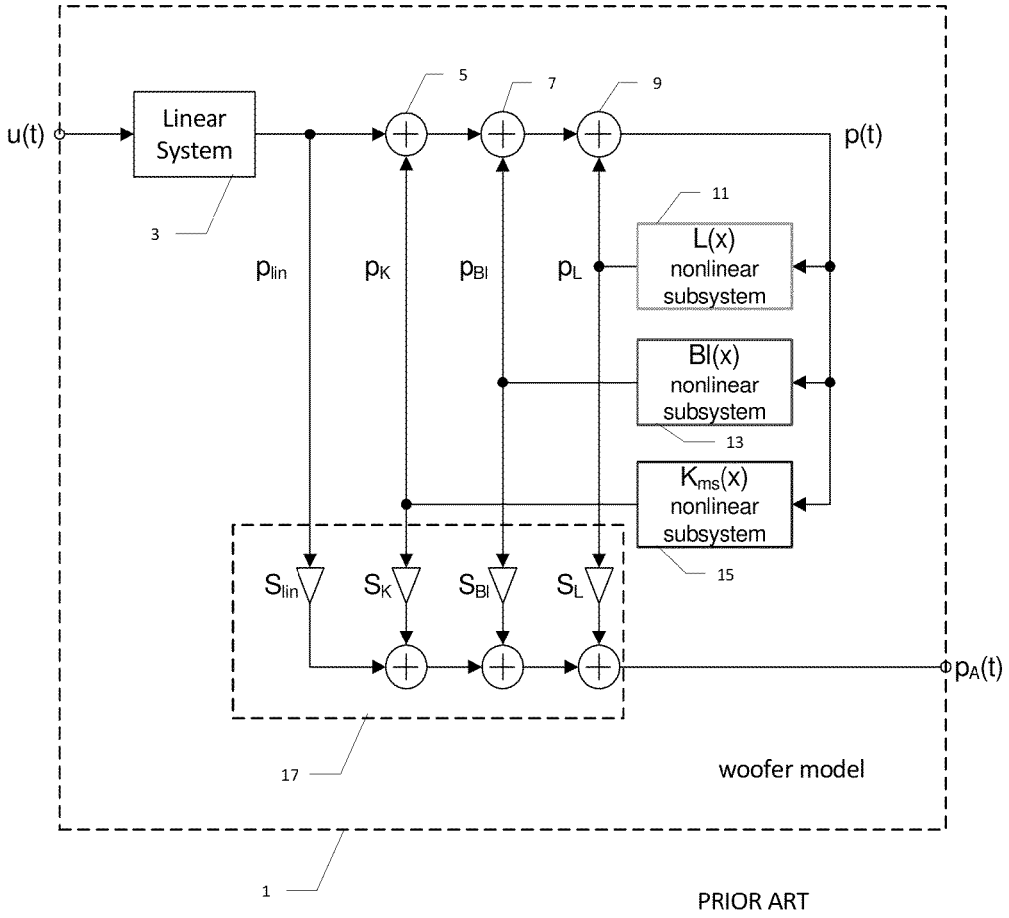
FIG. 1 is a general block diagram showing an auralization scheme according to the prior art.

FIG. 1 is a general block diagram showing an arrangement 1 for auralizing the signal distortion generated by the regular nonlinearities of a device under test according to prior art. The input signal u(t) is supplied to a linear system 3 which generates the linear sound pressure output signal $p_{lin}(t)$. Each of the nonlinear subsystems 11, 13, 15 models the effect of a separated nonlinearity of an electro-dynamic transducer and generates the nonlinear distortion signals $p_L$, $p_{Bl}$ and $p_K$ which correspond with the nonlinear inductance L(x), force factor Bl(x) and stiffness $K_{ms}(x)$, respectively.

The sound pressure output p(t) can be approximated by the sum of the linear sound pressure signal $p_{lin}$ and all distortion components $p_L$, $p_{Bl}$ and $p_K$ fed back to the input of the nonlinear subsystems. Those signal components are tapped at the input of the adders 5, 7, 9 and supplied to a mixing console 17 generating the auralization output signal $p_A(t)$. The linear and the nonlinear signal components can be individually scaled without changing the real sound pressure output p(t) or the internal states in the linear and nonlinear subsystems.

Figure 2:
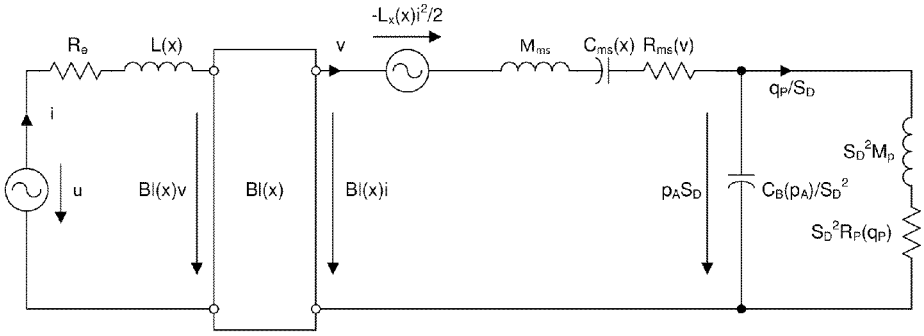
FIG. 2 shows an equivalent circuit modeling a vented-box loudspeaker system with linear and nonlinear parameters.

FIG. 2 shows an electrical equivalent network representing a vented-box loudspeaker system at low frequencies. The voltage u(t) and the current i(t) are the electrical signals accessible at the loudspeaker terminals. The displacement x and the velocity v of the voice coil cause nonlinear parameter variation of force factor Bl(x), inductance L(x), stiffness $K_{ms}(x)$ and mechanical resistance $R_{ms}(v)$. The voice coil resistance $R_e$, the moving mass $M_{ms}$ of the moving mechanical parts including air load, and acoustical mass $M_p$ of the air in the port are considered as linear and are represented by constant parameters. The acoustical compliance $C_B(p_A)$ of the air in the enclosure is a nonlinear function of sound pressure $p_A$, and the acoustic resistance $R_p(q_p)$ is a nonlinear function of the volume velocity $q_p$. The surface area $S_D$ of the driver diaphragm transforms the acoustical elements into mechanical elements as depicted in FIG. 2.

Figure 3:
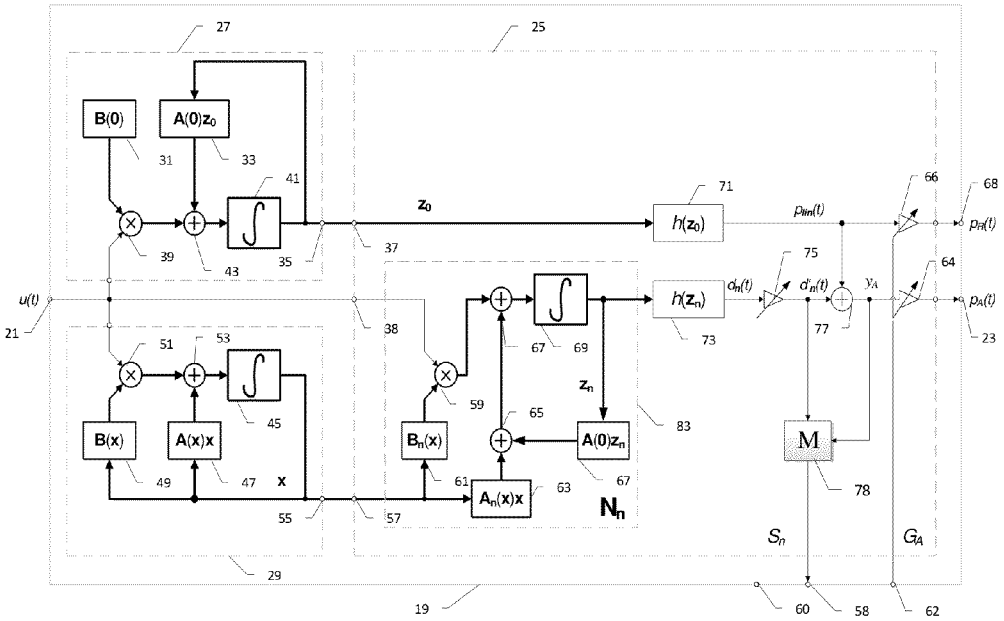
FIG. 3 shows an embodiment of the present invention for auralizing the total regular nonlinear distortion based on state-space modeling.

FIG. 3 shows an embodiment of the present invention based on state-space modeling. The auralization uses an arrangement 19 which comprises a nonlinear model 29, a linear model 27 and an auralization system 25 generating the auralization output signal $p_A(t)$ at the output 23. The voltage u(t) at the input 21 is supplied to the multiplier 51 in the nonlinear model 29 corresponding to Eq. (2), generating the state vector $x=[x_1, x_2, x_3, x_4, x_5]^T=[x, v, i, q_p, p_A]^T$.

The output signals of static nonlinearities 47 and 49 corresponding with $$A(x)=\begin{bmatrix} 0 & 1 & 0 & 0 & 0 \\ -\frac{K_{ms}(x_1)}{M_{ms}} & -\frac{R_{ms}(x_2)}{M_{ms}} & \frac{Bl(x_1)}{M_{ms}}+\frac{L_x(x_1)x_3}{2M_{ms}} & 0 & -\frac{S_D}{M_{ms}} \\ 0 & -\frac{Bl(x_1)+L_x(x_1)x_3}{L(x_1)} & -\frac{R_e}{L(x_1)} & 0 & 0 \\ 0 & 0 & 0 & -\frac{R_P(x_4)}{M_P} & \frac{1}{M_P} \\ 0 & \frac{S_D}{C_B(x_5)} & 0 & -\frac{1}{C_B(x_5)} & 0 \end{bmatrix} \text{ and} \tag{14}$$

$$B(x)=\begin{bmatrix} 0 & 0 & \frac{1}{L(x_1)} & 0 & 0 \end{bmatrix}^T, \tag{15}$$

are fed via multiplier 51 and adder 53 to an integrator 45, generating a state vector x at an output 55.

The linear model 27 uses as constant coefficients the vector B(0) and matrix A(0) according in Eq. (5). The outputs of the corresponding elements 31 and 33 are fed via multiplier 39 and adder 43 to the integrator 41 generating the linear state vector $z_0$ at an output 35.

The auralization system 25 has inputs 37, 38 and 57 provided with the linear state vector $z_0$, the input signal u(t) and the nonlinear state vector x, respectively. The system 25 comprises a nonlinear synthesis system 83, combiners 71 and 73 for generating the linear signal $p_{lin}(t)$ and the distortion component $d_n(t)$, respectively, a controllable scaling device 75 for scaling $d_n(t)$ by a scaling factor $S_n$, an adder 77 generating a virtual output signal $y_A$ and a scaling device 64 generating the auralization output signal $p_A(t)$ according to Eq. (7).

The nonlinear synthesis system 83 corresponds to Eq. (6) and comprises static nonlinear subsystems 61 and 63, the linear subsystem 67, adder 65 and 67, multiplier 59 and an integrator 69 providing the state vector $z_n$.

Both combiners 71 and 73 correspond with Eq. (3) which are, in the case of a vented box loudspeaker system $$p = h(x) = -\frac{d^2(C_{ab}(p_{box})p_{box})}{dt^2}\frac{\rho}{2\pi r}. \tag{16}$$

The linear signal $p_{lin}(t)$ is also scaled by a gain $G_A$ in element 66, giving the auralization reference signal $p_R(t)$ at output 68. A distortion measurement system 78 is provided with the distortion component $d_n(t)$ and the virtual output signal $y_A(t)$ and generates the Total Distortion Ratio according to Eq. (9) at output 58.

Figure 4:
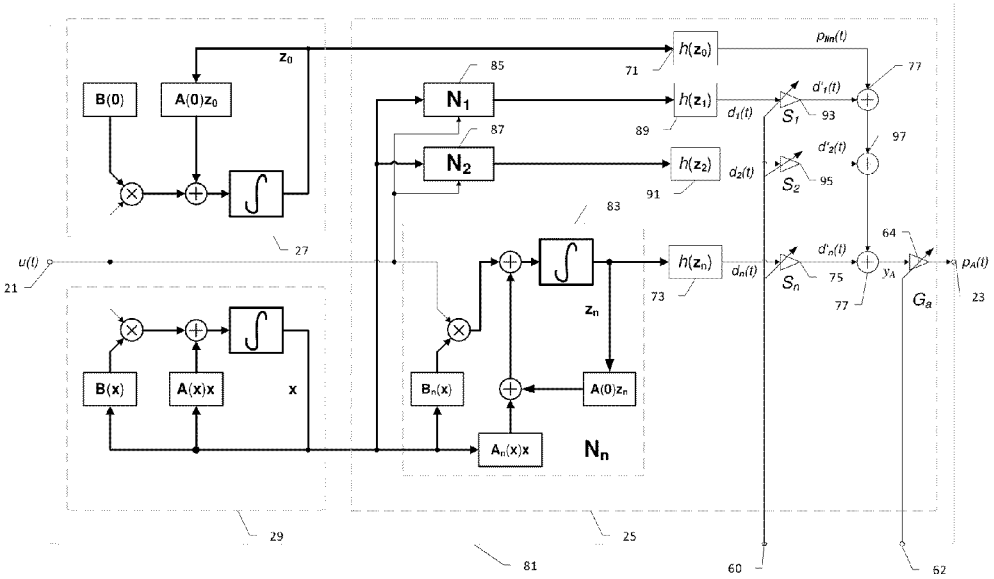
FIG. 4 shows an embodiment of the present invention for auralizing separated distortion components generated by regular nonlinearities based on state-space modeling.

FIG. 4 shows an embodiment 81 of the present invention for auralizing separated distortion components. The linear model 27 and the nonlinear model 29 are identical to those shown in FIG. 3. The auralization system 25 in FIG. 4 comprises multiple synthesis systems 85, 87 and 83 corresponding to Eq. (11), generating a nonlinear state vector $z_n$ for each regular nonlinearity.

The static nonlinear subsystems $B_n(x)$ and $A_n(x)$ with n=1, . . . , N comprise only one nonlinear parameter representing one nonlinearity of the device under test. For example, the subsystem n=1 representing the nonlinear stiffness $K_{ms}(x)$ of the suspension uses the matrix $$A_1(x) = \begin{bmatrix} 0 & 0 & 0 & 0 & 0 \\ \frac{K_{ms}(x_1) - K_{ms}(0)}{M_{ms}} & 0 & 0 & 0 & 0 \\ 0 & 0 & 0 & 0 & 0 \\ 0 & 0 & 0 & 0 & 0 \\ 0 & 0 & 0 & 0 & 0 \end{bmatrix} \tag{17}$$

and the vector $$B_1(x)=[0\ 0\ 0\ 0\ 0]^T. \tag{18}$$

For each state vector $z_n$ with n>1 there is a separate combiner 89, 91, a controllable scaling device 93, 95 and adder 77, 97, in addition to the elements 73, 75 and 77 disclosed in FIG. 3.

Figure 5:
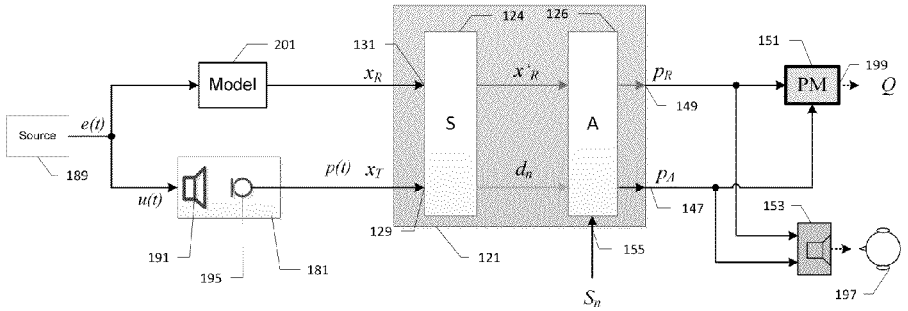
FIG. 5 shows a general signal flow chart of an alternative auralization scheme based on differential decomposition in accordance with the present invention.

FIG. 5 shows the alternative auralization scheme based on differential decomposition. The arrangement 121 comprises a separator 124 having inputs 129 and 131 provided with a test signal $x_T(t)$ and a reference signal $x_R(t)$, respectively. Both input signals may be generated in various ways depending on the particular application. FIG. 5 shows the application to a transfer system under test such as a loudspeaker system 191 operated in a listening room 181 and excited by an input signal u(t)=e(t) generated by the source 189. The sound pressure output p(t) of the loudspeaker is measured by a microphone 195 and used as the test signal $x_T(t)$. The reference signal $x_R(t)$ is generated by a reference system 201 using the input signal u(t). The separator 124 generates a transferred reference signal $x'_R(t)$ and a distortion component $d_n(t)$, which are supplied to the following auralization system 126, which generates an auralization reference signal $p_R(t)$ and an auralization output signal $p_A(t)$, which depends on the scaling factor S, from a control input 155. The signals $p_R(t)$ and $p_A(t)$ from outputs 149 and 147 are supplied to a reproduction system 153 used by a listener 197, and to a perceptive model 151 generating a quality grading Q at the output 199.

Figure 6:
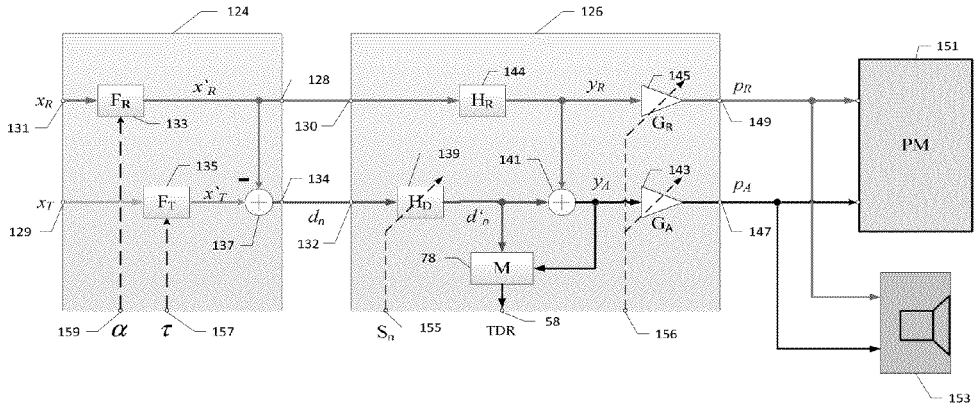
FIG. 6 shows a first embodiment of the differential decomposition.

FIG. 6 shows a first embodiment of the differential decomposition technique. The reference signal $x_R(t)$ at input 131 of the separator 124 is transformed into the signal $x'_R(t)$ at the output 128 by using a system 133 having a linear or nonlinear characteristic $F_R$ which can be changed by a gain α via a parameter input 159. The test signal $x_T(t)$ at the input 129 is transformed into the signal $x'_T(t)$ by using a system 135 having a linear characteristic $F_T$ which can be controlled by a time delay τ via a parameter input 157. A subtraction device 137 generates the distortion component $d_n(t)$ at an output 134.

A system 144 is provided with the transformed reference signal $x'_R(t)$, and may be used to generate a modified reference signal $y_R(t)$. The final scaling of $y_R(t)$ in 145 generates the auralization reference signal $p_A(t)$ at an output 149. The distortion component $d_n(t)$ is scaled by a controllable transfer system 139, which generates a modified distortion component $d'_n(t)$ that is added to the modified reference signal $y_R(t)$ in adder 141. The resulting virtual signal $y_A(t)$ is scaled by scaling factor $G_A$ in 143, generating the auralization output signal $p_A(t)$ at an output 147.

Figure 7:
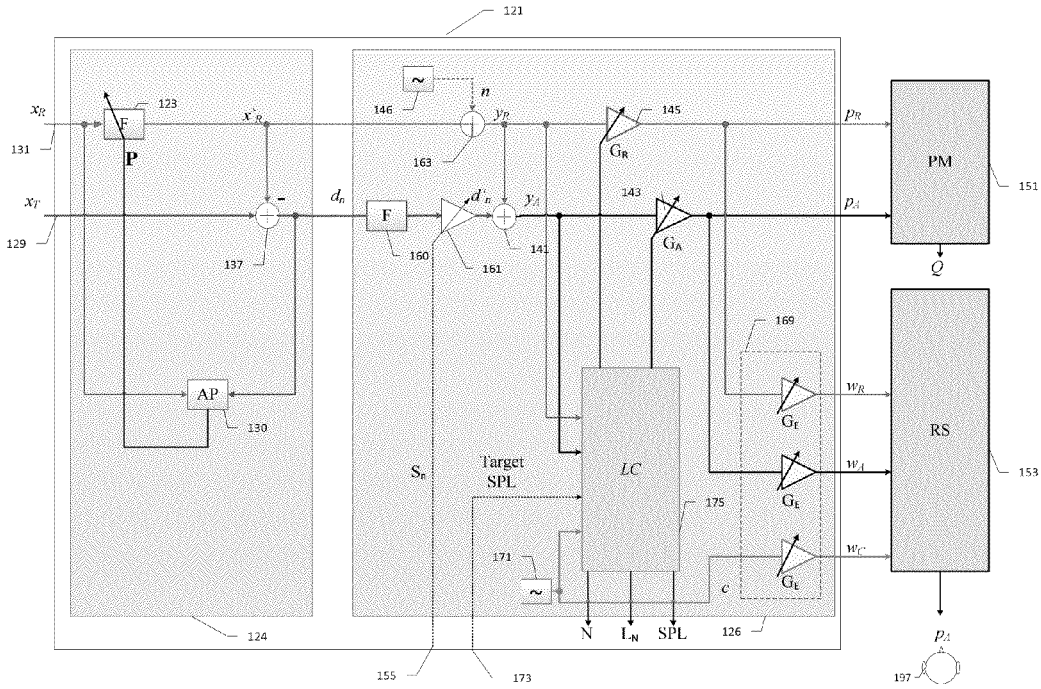
FIG. 7 shows a second embodiment of the differential decomposition.

FIG. 7 shows a second embodiment of the differential decomposition technique. The first transfer system $F_R$ in the separator 124 is realized by a controllable system 123 having a control input receiving a parameter vector P from a parameter estimator 130. The parameter estimator 130 is provided with the reference signal $x_R(t)$ from input 139 and with the distortion component $d_n(t)$ from the output of the subtraction device 137 The parameter estimator 130 uses an adaptive LMS-algorithm to suppress any signal components of the reference signal $x_R$ in the distortion component $d_n(t)$.

The controllable transfer system 139 is embodied by a linear filter 160 shaping the distortion component $d_n(t)$ and a scaling device 161 provided with the gain $S_n$ from input 155. The system 144 comprises a signal generator 146 generating a noise signal n(t), which is added to the reference signal $x'_R(t)$ in an adder 163 to simulate wind noise in an automotive audio application. The auralization system 126 comprises a loudness control unit 175 receiving the virtual signal $y_A(t)$, the modified reference signal $y_R(t)$ and target SPL or loudness value from the input 173 and generates gains $G_A$ and $G_R$, used in scaling devices 143 and 145, respectively.

The embodiment of the auralization system 126 comprises a generator 171 providing a calibration signal c(t) to a scaling unit 169, which produces the scaled calibration signal $w_c(t)=G_E c(t)$ supplied to the reproduction system 153. The gain $G_E$ ensures that the calibration signal and the auralization output signal can be rendered by the reproduction system 153 without clipping, at low distortion and sufficient signal-to-noise ratio. The magnitude $L_c$ of the original calibration signal c(t) is also determined in the auralization system 126 and transferred to the reproduction system. The gain of the reproduction system 153 is adjusted in such a way that the magnitude L of the reproduced calibration signal $w_c(t)$ equals the magnitude $L_c$ of the original calibration signal c(t). The gain $G_E$ is also applied to the auralization reference signal $p_R(t)$ and the auralization output signal $p_A(t)$.

Figure 8:
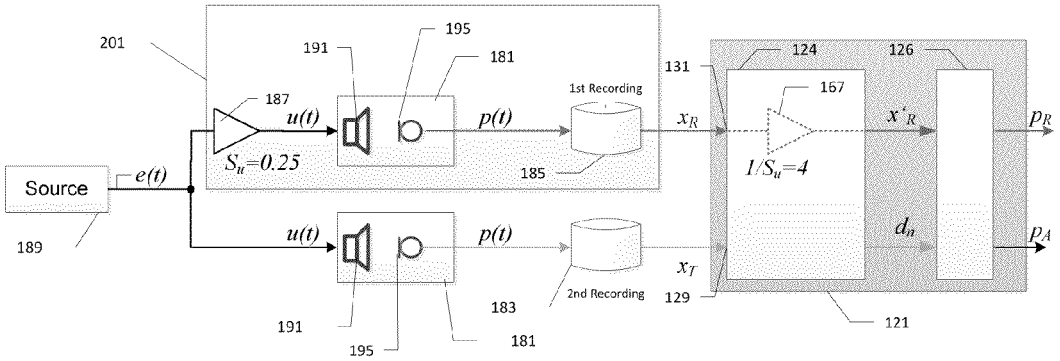
FIG. 8 shows an auralization of regular and irregular nonlinear distortion based on two measurements of the device under test in the small and large signal domain.

FIG. 8 shows a first application of the differential decomposition to auralize regular and irregular nonlinear distortion generated by a loudspeaker 191. In order to generate the test signal $x_T(t)$ and the reference signal $x_R(t)$, two measurements are performed while keeping the loudspeaker and a microphone 195 at the same position in the room 181 and using the same stimulus e(t) provided by a signal source 189. The reference system 201 comprises an additonal attenuator 187 to generate an attenuated input signal $u(t)=S_u e(t)$ which is supplied to the loudspeaker 191, where $S_u$ is an attenuation factor giving sufficient attenuation (e.g. −12 dB) to ensure that the loudspeaker 191 is operated in the small signal domain. The output signal p(t) is recorded by a mean 185 and used as the reference signal $x_R(t)$ at the input 131 of the separator 124.

In the second measurement, the original stimulus e(t) is directly supplied as the input signal u(t)=e(t) to the loudspeaker 191, and the output signal p(t) is recorded by mean 183 and supplied as the test signal $x_T(t)$ to the input 129 of the separator. The first transfer system 167 enhances the reference signal $x_R(t)$ by an inverse value of $S_u$ and generates a transferred reference signal $x'_R(t)$ which is comparable with the test signal $x'_T(t)$.

Figure 9:
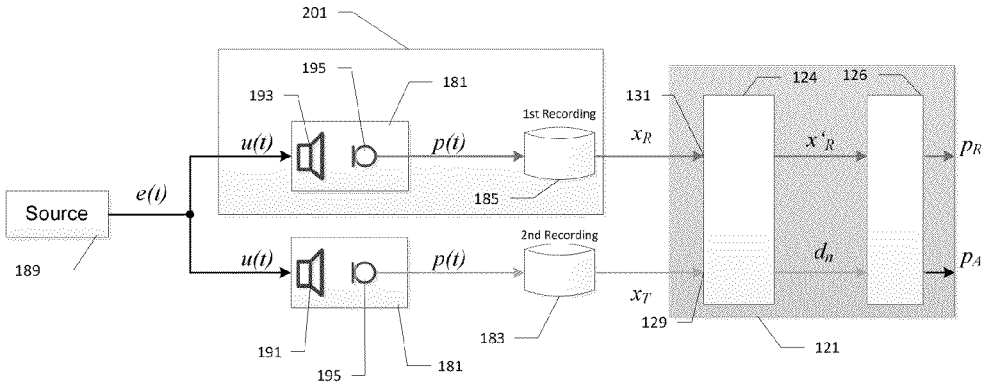
FIG. 9 shows an auralization of irregular nonlinear distortion based on the measurements of the device under test and a golden reference device.

FIG. 9 shows a second application of the differential decomposition to auralize the irregular nonlinear distortion generated by a loudspeaker 191 under test. In this case the reference system 201 uses a golden reference unit 193 to generate the reference signal $x_R(t)$. The golden reference unit 193 uses the same design as the loudspeaker 191 under test but having no defect generating irregular distortion. The loudspeakers are operated in the same place in room 181, and the position of the microphone 195 is identical. Thus, the linear distortion and the regular nonlinear distortion are similar. The sound pressure output p(t) generated by devices 191 and 193 is recorded and supplied as the test signal $x_T(t)$ and $x_R(t)$ to the inputs 129 and 131, respectively.

The invention claimed is:

1. An arrangement for assessing the audibility and annoyance of at least one distortion component $d_n(t)$ with n=1, . . . , N in the output signal p(t) of a device under test receiving an input signal u(t), by generating a virtual auralization output signal $p_A(t)$ containing said distortion component $d_n(t)$ at an adjustable magnitude according to a scaling factor $S_n$, characterized in that said arrangement comprises:

a nonlinear model using linear and nonlinear parameters of said device under test, having an input provided with the input signal u(t) and having an output generating a multitude of state signals in a state vector x which describes the state of said device under test in the small and large signal domain;

a linear model using linear parameters of said device under test, having an input provided with the input signal u(t) and having an output generating a multitude of linear state signals in a state vector $z_0$ which describes the state of the device under test in the small signal domain by a linear approximation; and an auralization system having a first input supplied with the input signal u(t), a second input provided with the state vector x from the output of the nonlinear model, a third input provided with the state vector $z_0$ from the output of the linear model, and an output which generates said auralization output signal $p_A(t)$.

2. An arrangement according to claim 1, characterized in that said auralization system comprises:

at least one nonlinear synthesis system having an input supplied with the input signal u(t) from the first input of the auralization system, a second input provided with the state vector x from the second input of the auralization system, and an output generating a state vector $z_n$ representing the nonlinear distortion in the state variables of the state vector x corresponding to one or more of said nonlinear parameters;

a first combiner with the transfer characteristic $h(z_0)$ having an input provided with the state vector $z_0$ from the output of said linear model, and an output generating a linear signal component $p_{lin}(t)$;

a second combiner with the transfer characteristic $h(z_n)$ having an input provided with the state vector $z_n$ from the output of said nonlinear synthesis system, and an output generating said distortion component $d_n(t)$;

a controllable scaling device having an input provided with said distortion component $d_n(t)$ from the output of the combiner, a control input provided with the scaling factor $S_n$, and an output which generates a scaled distortion component $d'_n(t)=S_n d_n(t)$;

an adder having a first input provided with the linear signal component $p_{lin}(t)$ from the output of the first combiner, a second input provided with said scaled distortion component $d'_n(t)$ from the output of said controllable scaling device, and an output generating a virtual output signal $y_A(t)$; and a scaling device having an input provided with the virtual signal $y_A(t)$ from the output of said adder, a control input receiving a scaling factor $G_A$, and an output which generates said auralization output signal $p_A(t)$.

3. An arrangement according to claim 2, characterized in that said nonlinear synthesis system comprises:

a first static nonlinear subsystem having an input supplied with the state vector x and generating a vector $B_n(x)$ at an output;

a second static nonlinear subsystem having an input supplied with the state vector x and generating a vector $A_n(x)x$ at an output, a multiplier having a first input provided with the vector $B_n(x)$ from the output of the first static nonlinear system, a second input provided with said input signal u(t) from the input of said nonlinear synthesis system, and an output generating the product of both signals;

a linear system having an input supplied with said state vector $z_n$ and generating a vector $A(0)z_n$ at the output;

an adder having a multitude of inputs which receive the outputs of the second static nonlinear subsystem, the multiplier, and the linear system, and which generates the vector signal $\dot{z}_n$ at an output; and an integrator receiving the vector signal $\dot{z}_n$ from the output of said adder and having an output which generates said state vector $z_n$.

4. An arrangement according to claim 3, characterized in that said auralization system comprises at least two synthesis systems, each synthesis system arranged to generate different kinds of nonlinear distortion corresponding with different nonlinearities of the system under test.

5. An arrangement according to claim 4, characterized in that said first static nonlinear subsystem and said second static nonlinear subsystem in each nonlinear synthesis system comprise only one particular nonlinear parameter of the device under test, the other nonlinearity of the device under test being approximated by linear parameters.

6. An arrangement according to claim 1, characterized in that said arrangement comprises:

a scaling unit having a first input provided with said auralization output $p_A(t)$ and generating a scaled auralization signal $w_A(t)=G_E p_A(t)$ at a first output;

a sound reproduction system having an input provided with said scaled auralization signal $W_A(t)$ from said first output of the scaling unit, and means for adjusting the gain of the reproduction system to generate a sound pressure output which corresponds with the magnitude of said auralization output signal $p_A(t)$.

7. An arrangement according to claim 6, characterized in that:

said arrangement comprises a generator having a first output providing a calibration signal c(t) and a second output providing the magnitude $L_c$ of the calibration signal;

said scaling unit having a second input provided with said calibration signal c(t) from said first output;

said scaling unit having a second output generating a scaled calibrated signal $w_c(t)=G_E c(t)$ which is supplied to the input of said sound reproduction system; and said sound reproduction system having an input provided with said scaled calibration signal $w_c(t)$;

said arrangement further comprising means for assessing the magnitude L of the sound pressure output while rendering the scaled calibration signal $w_c(t)$, and for adjusting the gain of the reproduction system to produce a magnitude L which corresponds with the original magnitude $L_c$.

8. An arrangement according to claim 1, characterized in that:

said auralization system has a reference output providing an auralization reference signal $p_R(t)$, which is identical with auralization output signal $p_A(t)$ for a scaling factor $S_n=0$ muting all distortion components $d'_n(t)=0$;

said arrangement contains a perceptive model having a first input provided with the auralization output signal $p_A(t)$ from the output of said auralization system, and a second input receiving said auralization reference signal $p_R(t)$ from said reference output.

9. An arrangement according to claim 2, characterized in that said arrangement contains:

a distortion measurement system having a first input receiving said distortion component $d'_n(t)$ from said input of said adder, having a second input receiving said virtual output $y_A(t)$ at the output of said adder, having an output generating a distortion ratio describing the amount of distortion in the auralization output.

10. An arrangement for assessing the audibility and annoyance of a distortion component $d_n(t)$ in an output signal p(t) of a device under test, by generating a virtual auralization signal $p_A(t)$ containing said distortion component $d_n(t)$ at an adjustable magnitude according to a scaling factor $S_n$, characterized in that said arrangement comprises:

a signal source having an output generating a stimulus e(t);

said device under test having an input receiving said stimulus e(t) from said output of said signal source and an output generating a test signal $x_T(t)$ which comprises linear and nonlinear signal distortion;

a reference system having an input provided with said stimulus e(t) from said output of said signal source and having an output generating a reference signal $x_R(t)$ comprising signal components which correspond with said linear and/or nonlinear signal distortion generated by said device under test;

a separator having a test signal input receiving said test signal $x_T(t)$, a reference input receiving said reference signal $x_R(t)$, and a first output generating a transferred reference signal $x'_R(t)$, and having a distortion output generating a distortion component $d_n(t)$; and an auralization system having a first input provided with the transferred reference signal $x'_R(t)$ from the first output of said separator, a second input provided with said distortion component $d_n(t)$ from the second output of said separator, a control input provided with said scaling factor $S_n$, and an output generating auralization output signal $p_A(t)$.

11. An arrangement according to claim 10, characterized in that said separator comprises:

a first transfer system $F_R$ having a linear or nonlinear transfer characteristic between an input and an output, said input provided with said reference signal $x_R(t)$ from said test signal input, said output generating said transferred reference signal $x'_R(t)$; and a subtraction device having a non-inverting input provided with said test signal $x_T(t)$ from said test signal input, an inverting input provided with said transferred reference signal $x'_R(t)$, and an output generating a distortion component $d_n(t)$.

12. An arrangement according to claim 11, characterized in that said separator comprises a parameter estimator having a first estimator input provided with said distortion component $d_n(t)$ from said output of said subtraction device, a second estimator input provided with said reference signal $x_R(t)$ from the input of said first transfer system $F_R$, and a first output providing at least one parameter to a control input of said first transfer system $F_R$.

13. An arrangement according to claim 10, characterized in that said auralization system comprises:

a controllable transfer system, having an input provided with said distortion component $d_n(t)$ from the output of said subtraction device, an output generating a modified distortion component $d'_n(t)$, and a control input provided with the scaling factor $S_n$ from the control input of said auralization system;

an adder having a first input provided with said modified distortion component $d'_n(t)$ and a second input provided with said transferred reference signal $x'_R(t)$ or a modified reference signal $y_R(t)$, and an output generating a virtual signal $y_A(t)$; and a scaling device having an input provided with the virtual signal $y_A(t)$ from the output of said adder, a control input receiving a scaling factor $G_A$, and having an output generating said auralization output signal $p_A(t)$.

14. An arrangement according to claim 13, characterized in that said controllable transfer system comprises:

a linear filter, having an input provided with said distortion component $d_n(t)$ from the input of said controllable transfer system, and an output generating a signal where particular spectral components are attenuated or enhanced; and a scaling device having an input provided with the signal from said linear filter output, having a control input provided with the scaling factor $S_n$ from the control input of said controllable transfer system and an output generating the modified distortion component $d'_n(t)$ supplied to the output of the controllable transfer system.

15. An arrangement according to claim 13, characterized in that said auralization system comprises:

a signal source generating an arbitrary signal n(t) at an output; and an adder having a first input receiving said transferred reference signal $x'_R(t)$ from said first input of the auralization system, a second input receiving said arbitrary signal n(t) from the output of said signal source, and an output generating said modified reference signal $y_R(t)$.

16. An arrangement according to claim 13, characterized in that said auralization system comprises a loudness control unit, having a first input provided with said virtual signal $y_A(t)$ from the output of said adder or said auralization output $p_A(t)$ from the output of said scaling device, a second input receiving a value describing the target amplitude of said auralization output signal $p_A(t)$, and an output generating the scaling factor $G_A$ supplied to the control input of said scaling device.

17. An arrangement according to claim 10, characterized in that said reference system is a model of said device under test, having a linear or nonlinear transfer characteristic between the input and the output.

18. An arrangement according to claim 10, characterized in that;

said signal source generates a deterministic stimulus e(t);

said reference system comprises an attenuator having an input receiving stimulus e(t) and having an output providing an attenuated stimulus $u(t)=S_u e(t)$ in accordance with an attenuation factor $S_u$ to said input of said device under test;

said reference system further comprises a recorder for storing said output signal p(t) of the device under test while exciting said device under test by said attenuated stimulus $u(t)=S_u e(t)$ from that output of said attenuator; and said recorder having an output providing the stored output signal p(t) as the reference signal $x_R(t)$ to said reference input of said separator while said device under test is excited by the deterministic stimulus e(t), and providing said output signal p(t) to said test signal input of said separator.

19. An arrangement according to claim 10 characterized in that said reference system is a device having properties similar to those of the device under test.

20. An arrangement according to claim 10, characterized in that said arrangement comprises:

a scaling unit having a first input provided with said auralization output $p_A(t)$ and generating a scaled auralization signal $w_A(t)=G_E p_A(t)$ at a first output;

a sound reproduction system having an input provided with said scaled auralization signal $w_A(t)$ from said first output of the scaling unit, and means for adjusting the gain of the reproduction system to generate a sound pressure output which corresponds with the magnitude of said auralization output signal $p_A(t)$.

21. An arrangement according to claim 20, characterized in that:

said arrangement comprises a generator having a first output providing a calibration signal c(t) and a second output providing the magnitude $L_c$ of the calibration signal;

said scaling unit having a second input provided with said calibration signal c(t) from said first output;

said scaling unit having a second output generating a scaled calibrated signal $w_c(t)=G_E c(t)$ which is supplied to the input of said sound reproduction system; and said sound reproduction system having an input provided with said scaled calibration signal $w_c(t)$;

said arrangement further comprising means for assessing the magnitude L of the sound pressure output while rendering the scaled calibration signal $w_c(t)$, and for adjusting the gain of the reproduction system to produce a magnitude L which corresponds with the original magnitude $L_c$.

22. An arrangement according to claim 10, characterized in that:

said auralization system has a reference output providing an auralization reference signal $p_R(t)$, which is identical with auralization output signal $p_A(t)$ for a scaling factor $S_n=0$ muting all distortion components $d'_n(t)=0$;

said arrangement contains a perceptive model having a first input provided with the auralization output signal $p_A(t)$ from the output of said auralization system, and a second input receiving said auralization reference signal $p_R(t)$ from said reference output.

23. An arrangement according to claim 13, characterized in that said arrangement contains:

a distortion measurement system having a first input receiving said distortion component $d'_n(t)$ from said input of said adder, having a second input receiving said virtual output $y_A(t)$ at the output of said adder, having an output generating a distortion ratio describing the amount of distortion in the auralization output.

24. A method for assessing the audibility and annoyance of at least one distortion component $d_n(t)$ with n=1, . . . , N in an output signal p(t) of a device under test which receives an input signal u(t), by generating a virtual auralization output signal $p_A(t)$ containing said distortion component $d_n(t)$ at an adjustable magnitude according to a scaling factor $S_n$, characterized in that said method comprises the steps of:

generating a multitude of state variables in a state vector x describing the state of said device under test in the small and large signal domain for said input signal u(t) by using a nonlinear model and linear and nonlinear parameters of said device under test;

generating a multitude of state variables in a state vector $z_o$ describing the state of said device under test in the small signal domain for said input signal u(t) by using a linear model of said device under test and linear parameters of said device under test; and generating said auralization output signal $p_A(t)$ in an auralization system using the input signal u(t), the state vector x from the output of the nonlinear model, and state vector $z_0$ from the output of the linear model.

25. A method according to claim 24, characterized in that said step of generating said auralization output signal further comprises the steps of:

synthesizing a state vector $z_n$ representing the nonlinear distortion in the state variables of the state vector x corresponding to one or more of said nonlinear parameters by using at least one nonlinear synthesis system which is provided with the input signal u(t) and the state vector x;

generating a linear signal component $p_{lin}(t)$ by using a first combiner with the transfer characteristic $h(z_0)$ which receives said state vector $z_0$ provided by said linear model;

generating said distortion component $d_n(t)$ by using a second combiner with the transfer characteristic $h(z_n)$ which receives said state vector $z_n$ provided by said nonlinear synthesis system;

scaling the distortion component $d_n(t)$ by said scaling factor $S_n$ and generating a scaled distortion component $d'_n(t)=S_n d_n(t)$;

generating a virtual output signal $y_A(t)$ by adding the linear signal component $p_{lin}(t)$ from the output of the first combiner to said scaled distortion component $d'_n(t)$; and scaling the virtual signal $y_A(t)$ by a scaling factor $G_A$ and generating said auralization output signal $p_A(t)$.

26. A method according to claim 25, characterized in that said step of synthesizing a state vector $z_n$, comprises the steps of:

generating a vector $B_n(x)$ by using a first static nonlinear subsystem supplied with the state vector x from said nonlinear model;

generating a vector $A_n(x)x$ by using a second static nonlinear subsystem supplied with the state vector x from said linear model;

generating a vector $B_n(x)u(t)$ by using a multiplier which receives the vector $B_n(x)$ from the output of the first static nonlinear system and said input signal u(t) from the input of said nonlinear synthesis system;

generating a vector $A(0)z_n$ by using a linear system which receives said state vector $z_n$ from said output of said nonlinear synthesis system;

generating the vector signal $\dot{z}_n$ by adding the outputs of the second static nonlinear subsystem, the multiplier and the linear system; and integrating the vector signal $\dot{z}_n$ to generate said state vector $Z_n$.

27. A method according to claim 26, characterized in that said steps of synthesizing a state vector $z_n$ and generating said distortion component $d_n(t)$ are performed for n=1 representing a first nonlinearity of the device under test, and repeated for n=2 representing a second nonlinearity of the device under test which is different from the first nonlinearity.

28. A method according to claim 27, characterized in that said steps of synthesizing a state vector $z_n$ and generating said distortion consider only one nonlinear parameter representing a particular nonlinearity of said device under test while all other nonlinear parameters are approximated by linear parameters.

29. A method according to claim 24, characterized in said method comprises the steps of:

supplying said auralization output $p_A(t)$ to a scaling unit;

determining a scaling factor $G_E$ for an optimal scaling of the auralization output $p_A(t)$ to avoid a loss of sound quality in the transfer of the auralization output signal $p_A(t)$ to a reproduction system;

supplying the scaled auralization signal $w_A(t)=G_E p_A(t)$ from the scaling unit to said reproduction system; and adjusting the gain of said reproduction system to render the auralization output $p_A(t)$ at the target amplitude.

30. A method according to claim 24, characterized in said method comprises the steps of:

supplying said auralization output $p_A(t)$ to a scaling unit;

determining a scaling factor $G_E$ for an optimal scaling of the auralization output $p_A(t)$ to avoid a loss of sound quality in the transfer of the auralization output signal $p_A(t)$ to a reproduction system;

supplying the scaled auralization signal $w_A(t)=G_E p_A(t)$ from the scaling unit to said reproduction system; and adjusting the gain of said reproduction system to render the auralization output $p_A(t)$ at the target amplitude.

31. A method according to claim 29, further comprising the steps of:

generating a calibration signal c(t);

determining the magnitude $L_c$ of said calibration signal c(t);

providing said calibration signal c(t) to said scaling unit;

scaling the calibration signal c(t) by the same scaling factor $G_E$ used for generating said scaled auralization signal;

supplying the scaled calibrated signal $w_c(t)=G_E c(t)$ from the scaling unit to said reproduction system; and adjusting the gain of said reproduction system to the value of a magnitude $L_c$ while rendering said scaled calibrated signal $w_c(t)$.

32. A method according to claim 30, further comprising the steps of:

generating a calibration signal c(t);

determining the magnitude $L_c$ of said calibration signal c(t);

providing said calibration signal c(t) to said scaling unit;

scaling the calibration signal c(t) by the same scaling factor $G_E$ used for generating said scaled auralization signal;

supplying the scaled calibrated signal $w_c(t)=G_E c(t)$ from the scaling unit to said reproduction system; and adjusting the gain of said reproduction system to the value of a magnitude $L_c$ while rendering said scaled calibrated signal $w_c(t)$.

33. A method according to claim 24, further comprising the steps of:

generating an auralization reference signal $p_R(t)$ in said auralization system which is identical with the auralization output signal $p_A(t)$ for a scaling factor $S_n=0$ where all distortion component $d'_n(t)=0$ are muted;

supplying said auralization output signal $p_A(t)$ and said auralization reference signal $p_R(t)$ to a perceptive model; and generating variables describing the audibility and annoyance said signal distortion.

34. A method according to claim 24, further comprising the steps of:

generating an auralization reference signal $p_R(t)$ in said auralization system which is identical with the auralization output signal $p_A(t)$ for a scaling factor $S_n=0$ where all distortion component $d'_n(t)=0$ are muted;

supplying said auralization output signal $p_A(t)$ and said auralization reference signal $p_R(t)$ to a perceptive model; and generating variables describing the audibility and annoyance said signal distortion.

35. A method according to claim 25, further comprising the steps of:

supplying said distortion component $d'_n(t)$ from the input of said adder to a distortion measurement system;

supplying said virtual output $y_A(t)$ from the output of said adder to said measurement system; and generating a distortion ratio in said measurement system which describes the amount of distortion in the auralization output.

36. A method for assessing the audibility and annoyance of a distortion component $d_n(t)$ in the output signal p(t) of a device under test, by generating a virtual auralization signal $p_A(t)$ containing said distortion component $d_n(t)$ at an adjustable magnitude according to a scaling factor $S_n$, characterized in that said method comprises:

generating a stimulus e(t) in a signal source;

supplying the stimulus e(t) to the input of said device under test;

capturing a test signal $x_T(t)$ describing said output signal p(t) containing linear and nonlinear distortion components;

supplying the stimulus e(t) to the input of a reference system;

generating distortion components in a reference signal $x_R(t)$ at the output of said reference system which correspond with at least one of said linear and nonlinear distortion components generated by said device under test;

supplying said test signal $x_T(t)$ and said reference signal $x_R(t)$ to a separator;

generating a transferred reference signal $x'_R(t)$ in said separator, said transferred reference signal $x'_R(t)$ describing said output signal p(t) without said distortion component $d_n(t)$;

generating a distortion component $d_n(t)$ in said separator;

supplying said distortion component $d_n(t)$ and said transferred reference signal $x'_R(t)$ to an auralization system which receives said scaling factor $S_n$; and generating said auralization output signal $p_A(t)$ in said auralization system.

37. A method according to claim 36, characterized in that said separator performs the steps of:

generating said transferred reference signal $x'_R(t)$ in a first transfer system $F_R$ by applying linear or nonlinear signal processing to said reference signal $x_R(t)$; and generating said distortion component $d_n(t)$ in a subtraction device by subtracting said transferred reference signal $x'_R(t)$ from said test signal $x_T(t)$ or said transferred test signal $x'_T(t)$.

38. A method according to claim 37, characterized in that said separator further performs the steps of:

providing said distortion component $d_n(t)$ from said output of said subtraction device to a first estimator input of a parameter estimator;

providing said reference signal $x_R(t)$ from the input of said first transfer system to a second estimator input of said parameter estimator;

estimating at least one parameter in said estimator which reduces undesired signal components in said distortion component $d_n(t)$; and supplying said parameter to a control input of said first transfer system $F_R$.

39. A method according to claim 36, characterized in that said auralization system performs the steps of:

scaling said distortion component $d_n(t)$ in a controllable transfer system by said scaling factor $S_n$ to generate a modified distortion component $d'_n(t)$;

generating a virtual signal $y_A(t)$ in an adder by adding said modified distortion component $d'_n(t)$ to said transferred reference signal $x'_R(t)$ or to a modified reference signal $y_R(t)$; and generating said auralization output signal $p_A(t)$ in a scaling device by scaling said virtual signal $y_A(t)$ by a scaling factor $G_A$.

40. A method according to claim 39, characterized in that said controllable transfer system performs the steps of:

filtering said distortion component $d_n(t)$ in a linear filter to suppress particular signal components or to emphasize other signal components and to produce a filter output signal;

providing said filter output signal to a scaling device and;

scaling said filter output signal in said scaling device by said scaling factor $S_n$ to generate said modified distortion component $d'_n(t)$ at the output of the controllable transfer system.

41. A method according to claim 39, characterized in that said auralization system performs the steps of:

generating an arbitrary signal n(t) at the output of a signal source; and generating said modified reference signal $y_R(t)$ in an adder by adding an arbitrary signal n(t) to said transferred reference signal $x'_R(t)$.

42. A method according to claim 39, characterized in that said auralization system performs the steps of:

supplying the target value of the magnitude or loudness of said auralization output signal $p_A(t)$ to a loudness control unit;

providing said auralization virtual signal $y_A(t)$ or said auralization output signal $p_A(t)$ to said loudness control unit; and generating a scaling factor $G_A$ in said loudness control unit by adjusting the magnitude or loudness of said auralization output signal $p_A(t)$ to said target value.

43. A method according to claim 36, further comprising modeling the linear or nonlinear transfer characteristic between the input and the output of said device under test in said reference system.

44. A method according to claim 36, further comprising the steps of:

generating a deterministic stimulus e(t) in a signal source;

providing an attenuated stimulus $u(t)=S_u e(t)$ in accordance with an attenuation factor $S_u$ to said input of said device under test;

storing said output signal p(t) of the device under test while exciting said device under test by said attenuated stimulus $u(t)=S_u e(t)$;

supplying the stored output signal p(t) as the reference signal $x_R(t)$ to said reference input of said separator while exciting said device under test by the deterministic stimulus e(t); and providing said output signal p(t) to said test signal input of said separator.

45. A method according to claim 36, further comprising the steps of:

selecting a reference device having similar properties as the device under test while generating said distortion component $d_n(t)$ at low amplitudes; and generating said reference signal $x_R(t)$ from said stimulus e(t) by using said reference device in said said reference system.

46. A method according to claim 39, further comprising the steps of:

supplying said distortion component $d'_n(t)$ from the input of said adder to a distortion measurement system;

supplying said virtual output $y_A(t)$ from the output of said adder to said measurement system; and generating a distortion ratio in said measurement system which describes the amount of distortion in the auralization output.

* * * * *